US007304026B2

(12) United States Patent
Heibel et al.

(10) Patent No.: US 7,304,026 B2
(45) Date of Patent: Dec. 4, 2007

(54) FABRIC CARE COMPOSITION COMPRISING POLYMER ENCAPSULATED FABRIC OR SKIN BENEFICIATING INGREDIENT

(75) Inventors: Marija Heibel, Highland Park, NJ (US); Lisa Bignell, Somerset, NJ (US); Myriam Peeters, Liege (BE); Alain Jacques, Blegny (BE); Amjad Farooq, Somerville, NJ (US)

(73) Assignee: Colgate-Palmolive Company, New York, NY (US)

( * ) Notice: Subject to any disclaimer, the term of this patent is extended or adjusted under 35 U.S.C. 154(b) by 218 days.

(21) Appl. No.: 10/826,490

(22) Filed: Apr. 15, 2004

(65) Prior Publication Data

US 2005/0256027 A1 Nov. 17, 2005

(51) Int. Cl.
*C11D 3/37* (2006.01)

(52) U.S. Cl. ..... 510/520; 510/515

(58) Field of Classification Search ..... 510/515, 510/520

See application file for complete search history.

(56) References Cited

U.S. PATENT DOCUMENTS

| | | | |
|---|---|---|---|
| 2,800,457 | A | 7/1957 | Green et al. |
| 3,041,288 | A | 6/1962 | Anthony |
| 3,415,758 | A | 12/1968 | Powell et al. |
| 3,870,542 | A | 3/1975 | Ida et al. |
| 4,145,184 | A | 3/1979 | Brain et al. |
| 5,112,688 | A | 5/1992 | Michael |
| 5,648,328 | A | 7/1997 | Angell et al. |
| 5,656,584 | A | 8/1997 | Angell et al. |
| 5,691,303 | A | 11/1997 | Pan et al. |
| 5,711,941 | A | 1/1998 | Behan et al. |
| 5,989,536 | A | 11/1999 | Deckner et al. |
| 6,261,483 | B1 | 7/2001 | Frank et al. |
| 6,620,777 | B2 | 9/2003 | Heibel et al. |
| 6,664,223 | B2 | 12/2003 | Zappone et al. |
| 6,864,223 | B2 | 3/2005 | Smith et al. |

(Continued)

FOREIGN PATENT DOCUMENTS

DE 43 13 085 A1 11/1990

(Continued)

OTHER PUBLICATIONS

Rompp Lexikon Chemie, 10th Edition, 1999, entry: Weichspuler.

(Continued)

*Primary Examiner*—John R. Hardee
(74) *Attorney, Agent, or Firm*—Rachel J. Lin

(57) ABSTRACT

Fabric softening compositions are disclosed comprising:
(a) from 0.01% to 50% by weight of a cationic or non-ionic softening compound; (b) at least 0.001% by weight of a water dispersible cross-linked cationic polymer derived from the polymerization of from 5 to 100 mole percent of a cationic vinyl addition monomer, from 0 to 95 mole percent of acrylamide, and from 5 to 500 ppm of a difunctional vinyl addition monomer cross-linking agent (c) from 0 to 5% by weight of a non-confined fragrance oil, (d) an effective amount of at least one fabric or skin beneficiating ingredient encapsulated within a first polymer material to form a polymer encapsulated beneficiating ingredient, said encapsulated ingredient being further coated with a cationic polymer and; (e) balance water and optionally one or more adjuvant materials.

21 Claims, 1 Drawing Sheet

U.S. PATENT DOCUMENTS

| | | | | |
|---|---|---|---|---|
| 6,949,500 | B2 | 9/2005 | Salesses et al. | |
| 2002/0132749 | A1* | 9/2002 | Smith et al. | 510/327 |
| 2003/0045447 | A1 | 3/2003 | Heibel et al. | |
| 2004/0071742 | A1* | 4/2004 | Popplewell et al. | 424/401 |
| 2004/0087477 | A1 | 5/2004 | Ness | |
| 2004/0102357 | A1 | 5/2004 | Smith et al. | |
| 2004/0116321 | A1 | 6/2004 | Salesses et al. | |
| 2004/0116322 | A1 | 6/2004 | Yianakopoulos et al. | |
| 2004/0138093 | A1 | 7/2004 | Brain et al. | |
| 2004/0142828 | A1 | 7/2004 | Popplewell et al. | |
| 2004/0229769 | A1 | 11/2004 | Smith et al. | |
| 2005/0009728 | A1 | 1/2005 | Smith et al. | |
| 2005/0112152 | A1 | 5/2005 | Popplewell et al. | |
| 2005/0153135 | A1 | 7/2005 | Popplewell et al. | |
| 2005/0233939 | A1 | 10/2005 | Heibel et al. | |
| 2005/0250670 | A1* | 11/2005 | Caswell et al. | 510/522 |
| 2006/0039934 | A1 | 2/2006 | Ness et al. | |

FOREIGN PATENT DOCUMENTS

| | | |
|---|---|---|
| EP | 0 395 282 A2 | 10/1990 |
| EP | 0 467 485 | 1/1992 |
| EP | 0 494 554 B1 | 3/1995 |
| EP | 0 799 887 A1 | 10/1997 |
| EP | 1407754 | 4/2004 |
| EP | 1 257 353 | 11/2004 |
| WO | WO 97/05220 | 2/1997 |
| WO | WO 99/06455 | 2/1999 |

OTHER PUBLICATIONS

Research Disclosure 429116, Jan. 2000, "Cationic polymeric thickeners useful in fabric softeners.".

* cited by examiner

Figure 1. Synthesis of Triethanolamine Esterquat
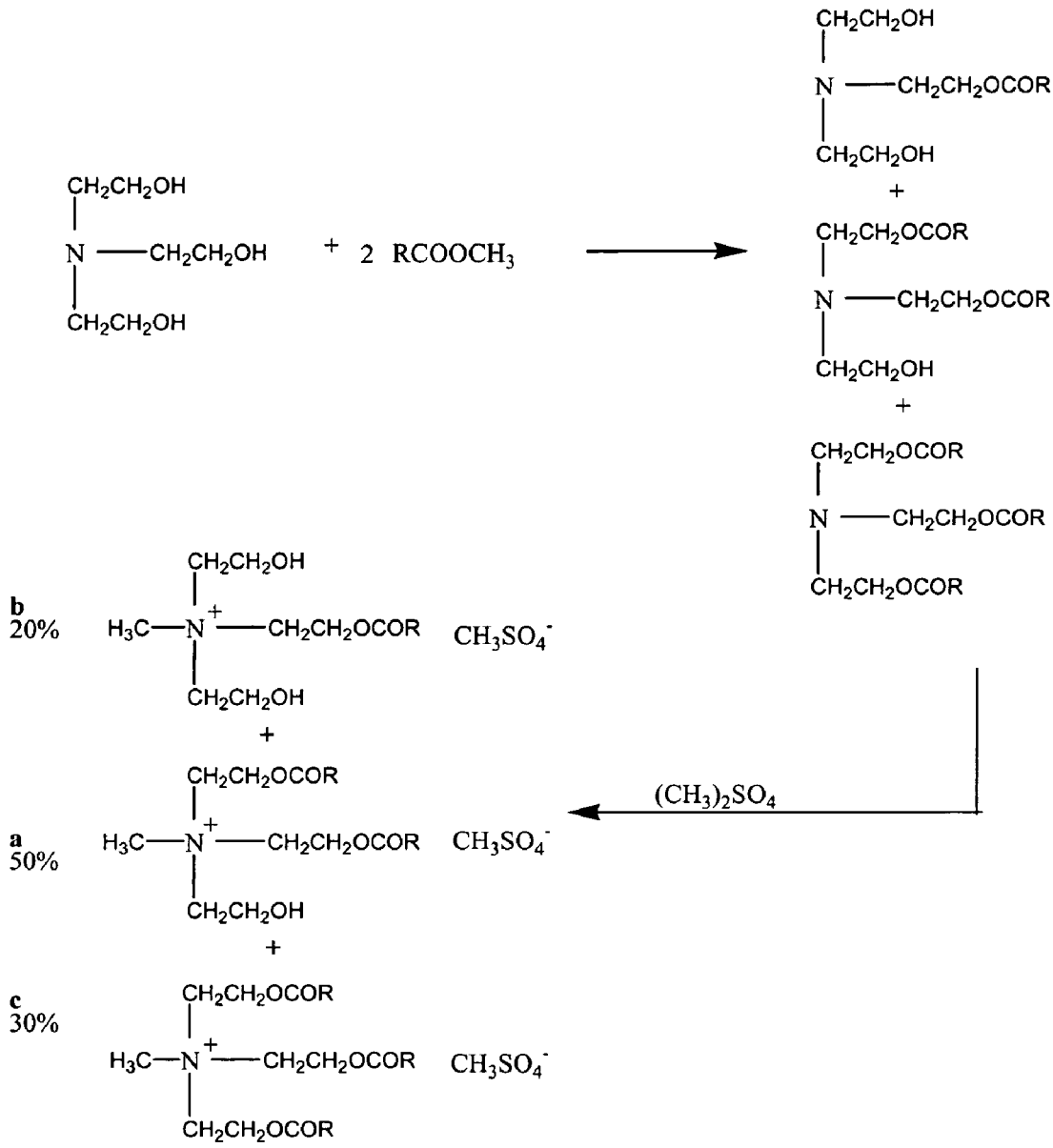

FABRIC CARE COMPOSITION COMPRISING POLYMER ENCAPSULATED FABRIC OR SKIN BENEFICIATING INGREDIENT

TECHNICAL FIELD

The present invention relates to a fabric care composition, which comprises an encapsulated "fabric or skin beneficiating ingredient". More particularly, this invention relates to fabric softening compositions, such as fabric softeners, fabric conditioners, fabric refreshers and detergents in a form of liquid, powder, gel or a composition applied onto a fabric substrate such as fabric softener sheets and/or wipes.

All above-mentioned compositions comprise: (a) from 0.01% to 50% by weight of a cationic or non-ionic softening compound; (b) at least 0.001% by weight of a water dispersible cross-linked cationic polymer derived from the polymerization of from 5 to 100 mole percent of a cationic vinyl addition monomer, from 0 to 95 mole percent of acrylamide, and from 5 to 500 ppm of a difunctional vinyl addition monomer cross-linking agent (c) from 0 to 5% by weight of a non-confined fragrance oil, (d) an effective amount of at least one fabric or skin beneficiating ingredient encapsulated within a first polymer material to form a polymer encapsulated beneficiating ingredient, said encapsulated ingredient being further coated with a cationic polymer and; (e) balance water and optionally one or more adjuvant materials.

This invention provides enhanced delivery of the fabric or skin beneficiating ingredient to the fabric.

BACKGROUND OF THE INVENTION

The present invention is based on the concept of fragrance, perfume, emollient or other fabric or skin beneficiating ingredient being released "on demand", e.g., release at a time of fabric/clothes use and/or wear.

The concept of controlled active release is known in the art, and various methods for achieving this have been developed. One aspect of the controlled release of perfume, for example, is providing slow release of perfume over an extended period of time. This is generally achieved by blending perfume or other fabric or skin beneficiating ingredient with a substance that will, in essence, "trap" the perfume and subsequently release small amounts of perfume over time.

One of the simplest embodiments consists of putting perfume in wax such as described in Canadian Patent No. 1,111,616 to Young, issued November 1981 and in U.S. Pat. No. 6,042,792 to Shefer et al. issued Mar. 28, 2000. Other embodiments encompass the complex technology of microencapsulation, such as in U.S. Pat. No. 4,464,271 to Munteanu et al. issued Aug. 7, 1984 which describes softener compositions containing a non-confined fragrance oil and a fragrance oil entrapped in solid particles.

An example of such microencapsulation technology is embodied in capsules filled with perfume, which are commercially marketed by, e.g., the Reed Pacific Company in Australia or Euracli Company in France. These capsules are adapted to break under friction and provide an instant "burst" of the fragrance when the capsules are ruptured. Microcapsules of the aminoplast type are used in the textile industry, and especially in so-called "intelligent fabrics" or "smart textiles", such as "Le carre de soie" by Hermes or by DIM (women panties with encapsulated emollient). More particularly, Hermes has commercialized luxurious scarves that release the Hermes perfume by friction created by contact with the neck of the consumer. Dim markets panties which release a relaxing agent for the legs. The microcapsules used are deposited on the fabric surface during the fabric finishing operation which is carried out by the textile manufacturer. These microcapsules are generally removed in the course of subsequent domestic washing; typically capsules can withstand about 5 washes before the fabric or skin beneficiating ingredients lose their intended effect.

From the above, it is clear that the preparation of microcapsules is a known art; preparation methods are, for instance, described in detail in a handbook edited by Simon Benita ("Microencapsulation; Methods and Industrial Applications, Marcel Dekker, Inc. N.Y., 1996), the contents of which are incorporated herein by reference for the preparation techniques described therein.

The preparation process is also the subject of several patents, such as U.S. Pat. No. 3,516,941 to Matson and U.S. Pat. No. 4,976,961 to Norbury and Chang, the disclosures of which are incorporated herein by reference.

Further reference is made to a number of patent publications, which describe the use of encapsulated fragrance in household applications, and more specifically in detergent compositions and in fabric softener products. For example, U.S. Pat. No. 4,145,184 to Brain et al. describes detergent compositions which contain perfumes in the form of friable microcapsules. Preferred materials for the microcapsule shell walls are the aminoplast polymers comprising the reaction product of urea and aldehyde.

U.S. Pat. No. 5,137,646 to Schmidt et al. issued August 1992, describes the preparation and use of perfumed particles, which are stable in fluid compositions and which are designed to break as the perfumed formulation is used, thereby releasing the perfumed particle. More specifically, this patent describes a fabric softener composition comprising one or more fabric- or fiber-softening or antistatic agents, and perfume particles comprising perfume dispersed in a solid core comprising a water-insoluble polymeric carrier material, such as polymers selected from the group consisting of polyethylene, polyamides, polystyrene, polyisoprenes, polycarbonates, polyesters, polyacrylates, vinyl polymers and polyurethanes. These cores are encapsulated by having a friable coating, a preferred coating being an aminoplast polymer which is the reaction product of an amine selected form the group consisting of urea and melamine and an aldehyde selected from the group consisting of formaldehyde, acetaldehyde and glutaraldehyde.

The perfume/controlled release agent may also be in the form of particles mixed into the laundry composition. According to one known method perfume is combined with a water-soluble polymer to form particles which are then added to a laundry composition, as described in U.S. Pat. No. 4,209,417 to Whyte issued June 1980; U.S. Pat. No. 4,339,356 to Whyte issued July 1982; and U.S. Pat. No. 3,576,760 to Gould et al. issued April 1971; and U.S. Pat. No. 5,154,842 to Walley et al. issued October 1992.

The perfume may also be adsorbed onto a porous carrier material, which may be a polymeric material. See, for example, U.S. Pat. No. 5,137,646 to Schmidt et al. Further examples are disclosed in US 2004/0072720 A1, US 2004/0071746 A1, US 2004/0072719 A1, and US 2004/0071742 A1 all of which are incorporated herein by reference. These patent applications describe fragrance materials which are encapsulated within a first polymer selected from the group consisting of a vinyl polymer; an acrylate polymer, melamine formaldehyde polymer, urea formaldehyde polymer and mixtures thereof; said first polymer being further coated with a cationic polyamine or selected from polysaccharides, cationically modified starch, cationically modified guar polysiloxanes, poly diallyl dimethyl ammonium halides, copolymers of poly diallyl dimethyl ammonium chloride, imidazolinium halides.

U.S. Pat. No. 4,234,627 discloses a liquid fragrance coated with an aminoplast shell further coated by a water insoluble meltable cationic coating in order to improve the deposition of capsules from fabric conditioners. U.S. Pat. No. 6,194,375 discloses the use of hydrolyzed polyvinyl alcohol to aid deposition of fragrance-polymer particles from wash products. U.S. Pat. No. 6,329,057 discloses use of materials having free hydroxy groups or pendant cationic groups to aid in the deposition of fragranced solid particles from consumer products.

In our U.S. Pat. No. 6,620,777 we described a fabric softening composition comprising fabric or skin beneficiating ingredient(s) within friable microcapsules of aminoplast polymeric shell.

Despite these and many other disclosures there is an ongoing need for the improved delivery of fragrance materials for various rinse-off products that provide improved performance.

SUMMARY OF THE INVENTION

The present invention provides a stable fabric softening composition comprising:

(a) from 0.01% to 50% by weight of a cationic or non-ionic softening compound; (b) at least 0.001% by weight of a water dispersible cross-linked cationic polymer derived from the polymerization of from 5 to 100 mole percent of a cationic vinyl addition monomer, from 0 to 95 mole percent of acrylamide, and from 5 to 500 ppm of a difunctional vinyl addition monomer cross-linking agent; (c) from 0 to 5% by weight of non-confined fragrance oil; (d) an effective amount of at least one fabric or skin beneficiating ingredient encapsulated within a first polymer material to form a polymer encapsulated beneficiating ingredient, said encapsulated ingredient being further coated with a cationic polymer and; and (e) balance water and optionally one or more adjuvant materials.

In a particular embodiment of the invention the softening composition further includes a chelating compound capable of chelating metal ions and selected from the group consisting of amino carboxylic acid compounds, organo aminophosphonic acid compounds and mixtures thereof.

For purposes of the present invention a "fabric or skin beneficiating ingredient" is any substance which improves or modifies the chemical or physical characteristics of the fabric being treated therewith. Examples of such fabric or skin beneficiating ingredients include perfumes or fragrance oils, elasticity improving agents, vitamins, skin conditioners, antibacterial agents, antistatic agents, enzymes, crease proofing agents, UV absorbers, heat proofing agents and brighteners. The most preferred fabric or skin beneficiating ingredient is perfume. Perfume is an especially suitable encapsulated fabric or skin beneficiating ingredient for use herein since its volatility generally creates special problems when it is used in conventional (i.e. un-encapsulated) fabric treatment compositions, such as, fabric softeners.

The terms "fragrance oil" or "perfume" as used herein refer to any odoriferous material which may be selected according to the desires of the formulator from natural or synthetically produced fragrant substances to impart a desired fragrance. In general, such perfume materials or fragrance oils are characterized by a vapor pressure above atmospheric pressure at ambient temperatures and are ordinarily liquid at ambient temperatures, but may also be solids such as the various camphoraceous perfumes known in the art. A wide variety of chemicals are known for perfumery uses, including blends of various organic compounds such as aldehydes, ketones, esters, and the like. More commonly, naturally-occurring plant and animal oils and exudates comprising complex mixtures of various chemical components are known for use as perfumes, and such materials can be used herein. The perfumes herein can be relatively simple in their composition, or can comprise highly sophisticated, complex mixtures of natural and synthetic chemical components, all chosen to provide a desired fragrance.

The fabric softening compositions described herein may be in the form of a liquid, powder or gel as well as a fabric softener sheet. The liquid form of the composition is generally used in domestic automatic washing machine use.

DETAILED DESCRIPTION OF THE INVENTION

The fabric softener compositions of the invention contain at least one fabric or skin beneficiating ingredient agent encapsulated in microcapsules which are used as a delivery vehicle for such ingredient in, for example, a domestic laundry operation.

The present compositions prolong the effect provided by encapsulated fabric or skin beneficiating ingredients on the surfaces treated with said compositions. For instance, a longer lasting performance is noted with respect to perfume on dry clothes treated with a fabric softener composition of the invention.

Moreover, compositions which comprise the cationic cross-linked polymer provide an excellent delivery vehicle for microcapsules on the substrates of treated fabrics. In addition the cross-linked cationic polymer provides thickening and stability benefits of compositions comprising the fragrance microcapsules.

The microcapsules are made of a hard polymeric material that is friable and which ruptures upon gentle rubbing. In this way, an intense burst of fabric or skin beneficiating ingredient can, for instance, be detected on fabric rinsed with a softener composition of the invention during the ordinary manipulation of the fabric. The perfume, for example, is released at the time the user wears the clothes. Dry towels washed with a fabric softener of the invention have a pleasing fragrance and manifest a particularly intense "fragrance burst" when used.

The compositions of the invention protect the friable microcapsules during product storage prior to use and during use and also maximize the deposition of microcapsules onto fabric surface, so that a good fraction of capsules in the composition deposit on the fabric.

Microcapsules

There are several types of microcapsules differentiated by their chemical nature, and by the encapsulating process. The choice of the type of microcapsules must be made according to the desired properties of the capsules in the contemplated applications. Microcapsules are currently used in the fields of chemistry (printing and recording, in carbon-less paper); food (aromas preservation), medicine and pharmacy (controlled release, target drug delivery) among other applications.

The microcapsules which are useful in the compositions of the present invention are disclosed in patent applications US 2004/0072720 A1, US 2004/0071746 A1, US 2004/0072719 A1, and US 2004/0071742 A1 all of which are incorporated herein by reference. In these microcapsules, fragrance materials are encapsulated within a first polymer selected from the group consisting of a vinyl polymer; an acrylate polymer, melamine formaldehyde polymer, urea formaldehyde polymer and mixtures thereof; said first polymer being further coated with a cationic polyamine or selected from polysaccharides, cationically modified starch, cationically modified guar, polysiloxanes, poly diallyl dimethyl ammonium halides, copolymers of poly diallyl dimethyl ammonium chloride, imidazolinium halides.

Suitable microcapsules which contain a fragrance oil and which are useful in the composition of the present invention can be in the form of an "encapsulated fragrance slurry", comprising:

a. an encapsulated fragrance;

b. optional a non-confined (free) fragrance;

c. an encapsulating shell material; and d. water

Fragrance microcapsules prepared by coating a melamine-formaldehyde polymer with a reaction product of 1H-imidazole with chloromethyl oxirane are suitable for use.

The Fabric softener compositions of the invention can comprise any effective amount of the friable microcapsules. By "effective amount" is meant an amount of microcapsules sufficient that the number becoming attached to the fabric during the laundering operation is enough to impart a noticeable odor to the laundered fabric when the fabric is rubbed or scratched.

Perfume or skin beneficiating ingredient in the microcapsules may be mixed with a polymer or non-polymeric carrier material or surfactant or solvent or mixtures thereof.

Such polymeric materials broadly include polyethylenes, polyamides, polystyrenes, polyisoprenes, polycarbonates, polyesters, polyacrylates, vinyl polymers and polyurethanes. Non-polymeric carriers may include fatty alcohols, esters, fatty amidoamine, wax, fatty quaternary ammonium compound etc. Perfume or skin beneficiating ingredient may also be mixed with clay, hydroxypropyl cellulose, silica, xanthan gum, ethyl cellulose, microcrystalline cellulose, carrageenan, propylene glycol alginate, sodium alginate, methyl cellulose, sodium carboxymethyl cellulose; and Veegum (manufactured by R. T. Vanderbilt Company), a natural inorganic complex of colloidal magnesium aluminum silicate, ethylene glycol, propylene glycol, glycerol, pyrrolidine, acetamide, ethylene diamine, piperzine, amino acids, ureas and hydroxyethyl modified ureas, diisodecyl adipate, phthalate esters and the like.

Cross-Linked Cationic Polymer

The cationic cross-linked polymer as described herein is derivable from a water soluble cationic ethylenically unsaturated monomer or blend of monomers, which is cross-linked by a cross-linking agent comprising polyethylenic functions. Suitable cross-linked cationic polymers are known in the art, and for instance described in U.S. Pat. No. 4,806,345. This patent describes personal care compositions which have as a thickening agent a cross-linked cationic vinyl addition polymer derived from the polymerization of a cationic vinyl addition monomer, acrylamide, and 50-500 ppm of a difunctional vinyl addition monomer for cross-linking purposes.

Also suitable but less preferred polymers are described in WO 90/12862 in the name of British Petroleum. This publication discloses aqueous based fabric conditioning formulations comprising a water dispersible cationic softener and as a thickener a cross-linked cationic polymer that is derivable from a water soluble cationic ethylenically unsaturated monomer or blend of monomers, which is cross-linked by 5 to 45 ppm of a cross-linking agent comprising polyethylenic functions.

A commercially available cationic polymer related to the aforementioned WO 90/12862 is a cross-linked cationic copolymer of about 20% acrylamide and about 80% of trimethylammonioethylmethacrylate salt cross-linked with 5-45 ppm methylene bis acrylamide (MBA). The cross-linked polymer is supplied in a liquid form as an inverse emulsion in mineral oil and is marketed by Honeywill & Stein.

Further, in Research Disclosure, page 136, no. 429116 of January 2000, SNF Floerger describes particular cationic polymeric thickeners that are useful in the softening compositions of the invention. These described thickeners are branched and/or cross-linked cationic polymers formed from monoethylenically unsaturated monomers being either water soluble cationic monomers or blends of cationic monomers that may consist of cationic monomers alone or may comprise a mixture from 50-100% cationic monomer or blend thereof and from 0-50% of non-ionic monomers in the presence of a cross-linking agent in an amount of 60 to 3000 ppm and of chain transfer agent in an amount of between 10 and 2000 ppm. The cationic monomers are selected from the group of dimethylaminopropyl methacrylamide, dimethylaminopropylacrylamide, diallylamine, methyldiallylamine, dialkylaminoalkylacrylate and methacrylate, dialkylaminoalkyl acrylamide or methacrylamide, derivatives of the previously mentioned monomers or quaternary or acid salts thereof. Suitable non-ionic monomers are selected from the group consisting of acrylamide, methacrylamide, N-alkyl acrylamide, N-vinyl pyrrolidone, vinylacetate, vinyl alcohol, acrylate esters, allyl alcohol, and derivatives thereof. The cross-linking agents are methylene bisacrylamide and all diethylenically unsaturated compounds.

Cross-linked cationic vinyl polymer may be used, derived from the polymerisation of from 5 to 100 mole percent of a cationic vinyl addition monomer, and especially a quaternary ammonium salt of dimethylaminoethyl methacrylate, from 0 to 90 mole percent of acrylamide, and from 70 to 250 ppm, preferably between 75 and 200 ppm and most preferably between 80 and 150 ppm, of a difunctional vinyl addition monomer.

Generally, such polymers are prepared as water-in-oil emulsions, wherein the cross-linked polymers are dispersed in mineral oil, which may contain surfactants. During finished product making, when in contact with the water phase, the emulsion inverts, allowing the water-soluble polymer to swell.

Cationic polymers for use in the present invention particularly include cross-linked copolymers of a quaternary ammonium acrylate or methacrylate in combination with an acrylamide comonomer.

Nonionic polymers are also useful for the present invention. Examples of such nonionic polymers which can be used include poly(ethylene oxide), non-ionic polyacrylamide, nonionic cellulose ether and modified non-ionic starch polymers.

Cationic Softening Compound

In the compositions of the present invention various types of fabric softeners may be useful which are in the category of cationic, nonionic, and anionic surfactants. In addition, other conventional ingredients for fabric softening and conditioning compositions, such as clays, silicones, fatty alcohols, fatty esters and the like may optionally be added.

The cationic softeners include esterquats, imidazolinium quats, difatty diamido ammonium methyl sulfate, difatty amidoamine and ditallow dimethyl ammonium chloride. Suitable cationic softeners are described in U.S. Pat. No. 5,939,377, U.S. Pat. No. 6,020,304, U.S. Pat. No. 4,830,771, U.S. Pat. No. 5,501,806, and U.S. Pat. No. 4,767,547, all of which disclosures are incorporated herein by reference.

A particular softener for use in the present invention is produced by reacting two moles of fatty acid methyl ester with one mole of triethanolamine followed by quaternization with dimethyl sulfate (further details on this preparation method are disclosed in U.S. Pat. No. 3,915,867). The reaction products are distributed as follows: (a) 50% diesterquat material; (b) 20% monoesterquat; and (c) 30% triesterquat.

In the present specification, the product mixture of to the above reaction is referred to as "esterquat". It is commercially available from, e.g., Kao Corp. as for example, Tetranyl AT1-75™.

BRIEF DESCRIPTION OF THE DRAWING

Depending on the esterification process conditions of the reaction shown in FIG. 1, the distribution of the three species (mono, di and tri) may vary. The esterquat compounds described herein are prepared by quaternizing the product of the condensation reaction between a fatty acid fraction containing at least one saturated or unsaturated linear or branched fatty acid, or derivative, and at least one functionalized tertiary amine, wherein the molar ratio of the fatty acid fraction to tertiary amine is from about 1.7:1.

The method of manufacture for such a esterquat surfactant is described in U.S. Pat. No. 5,637,743 (Stepan), the disclosure of which is incorporated herein by reference.

The aforementioned molar ratio will determine the equilibrium between the mono, di and tri-esterquat compounds in the products. For example, using a molar ratio of about 1.7 results in a normalized distribution of about 34% monoesterquat, about 56% of di-esterquat and about 10% of tri-esterquat which is a fatty ester quat compound in accordance with the invention. On the other hand, for example, using a molar ratio of about 1.96 results in a normalized distribution of about 21% mono-esterquat, 61% of di-esterquat and 18% of tri-esterquat.

Nonionic Softening Compound

In the compositions of the present invention various types of non-ionic softeners may be useful. An exemplary nonionic softener is of the following structure (can be used as such or in the partially neutralized form as described in U.S. Pat. No. 5,501,806).

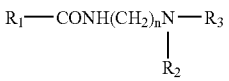

wherein $R_1$=$C_{12}$ to $C_{30}$ alkyl or alkenyl, $R_2$=$R_1CONH(CH_2)_m$, $R_3$=$(CH_2CH_2O)_pH$, $CH_3$ or H, n=1 to 5, m=1 to 5, and p=1 to 10.

In a more preferred softening compound of formula (I), $R_1$=$C_{16}$ to $C_{22}$ alkyl, n=1 to 3, m=1 to 3, and p=1.5 to 3.5.

In the above formulas, $R_1$ and $R_2$ are each, independently, long chain alkyl or alkenyl groups having from 12 to 30 carbon atoms, preferably from 16 to 22 carbon atoms, such as, for example, dodecyl, dodecenyl, octadecyl, octadecenyl. Typically, $R_1$ and $R_2$ will be derived from natural oils containing fatty acids or fatty acid mixtures, such as coconut oil, palm oil, tallow, rape oil and fish oil. chemically synthesized fatty acids are also usable. The saturated fatty acids or fatty acid mixtures, and especially hydrogenated tallow (H-tallow) acid (also referred to as hard tallow), may be used. Generally and preferably $R_1$ and $R_2$ are derived from the same fatty acid or fatty acid mixture.

$R_3$ represents $(CH_2CH_2O)pH$, $CH_3$ or H, or mixtures thereof may also be present. When $R_3$ represents the preferred $(CH_2CH_2O)pH$ group, p is a positive number representing the average degree of ethoxylation, and is preferably from 1 to 10, especially 1.5 to 6, and most preferably from about 2 to 4, such as 2.5, n and m are each integers of from 1 to 5, preferably 2 to 4, especially 2. The compounds of formula (I) in which $R_3$ represents the preferred $(CH_2CH_2O)$ pH group are broadly referred to herein as ethoxylated amidoamines, and the term "hydroxyethyl" is also used to describe the $(CH_2CH_2O)pH$ group.

Another preferred non-ionic softener is a fatty amide compound, generally described as condensation products of monobasic fatty acids having at least 8 carbon atoms with dipropylene triamine and or diethylene triamine. These condensates are subsequently reacted with urea. The resulting product is optionally methylolated by adding formaldehyde.

Typical compounds of this class are:

Bis/tetra stearyl carbamidoethyl urea

Bis/tetra tallowyl carbamidoethyl urea

The manufacture of such fatty amide compounds is described in U.S. Pat. No. 3,956,350 to Ciba-Geigy.

A process for the production of textile co-softener fatty amide compound comprises the steps of condensing with stirring and heating an aliphatic monobasic fatty acid of at least 8 carbon atoms or mixture of said acids, provided that the fatty acid be at least 40 mole % of saturated or monounsaturated straight-chain fatty acid with at least 12 carbon atoms, with diethylene triamine, dipropylene triamine or mixtures thereof in a molar ratio of fatty acid to triamine of about 2:1 to form a bis-amide, heating the resulting fatty acid amine condensation product with urea in a molar ratio of about 1:0.5 to 1:1 so that 0.5 to 1 mole of ammonia per mole of fatty acid amine condensation product is given off, and finally, treating the resulting urea condensation product with 1 to 5 moles of formaldehyde per mole of urea to methylolate the urea condensation product. Wherein at least 40 mole % of the fatty acid consists of saturated or monounsaturated straight-chain fatty acids with at least 14 carbon atoms. Wherein the fatty acid is a mixture of fatty acids having 12 to 24 carbon atoms. Wherein the fatty acid is condensed with with diethylene triamine.

Chelating Compound

A sequestering or chelating compound may be included in the fabric softening compositions of the invention at a concentration of from 0.001% to 5%, by weight. The useful sequestering compounds are capable of sequestering metal ions and are present at a level of at least 0.001%, by weight, of the softening composition, preferably from about 0.001% (10 ppm) to 0.5%, and more preferably from about 0.005% to 0.25%, by weight. The sequestering compounds which are acidic in nature may be present either in the acidic form or as a complex/salt with a suitable counter cation such as an alkali or alkaline earth metal ion, ammonium or substituted ammonium ion or any mixtures thereof.

The sequestering compounds are selected from among amino carboxylic acid compounds and organo aminophosphonic acid compounds, and mixtures of same. Suitable amino carboxylic acid compounds include: ethylenediamine tetraacetic acid (EDTA); N-hydroxyethylenediamine triacetic acid; nitrilotriacetic acid (NTA); and diethylenetriamine pentaacetic acid (DEPTA).

Suitable organo aminophosphonic acid compounds include: ethylenediamine tetrakis (methylenephosphonic acid); 1-hydroxyethane 1,1-diphosphonic acid (HEDP); and aminotri (methylenephosphonic acid).

EXAMPLE 1

The preparation of a softening composition of the invention is described below:

Materials

1. Variable Speed Mixer with 4 bladed paddles (diameter is 4 in.~10.2 cm). (Tekmar RW 20 DZM)
2. 4000 ml glass beaker (diameter is 6 in.~15.2 cm)
3. 600 ml glass beaker.
4. Heated magnetic stirring plate with magnetic stirring bar.
5. Scale capable of reading 5-kg+/−0.01 g.
6. Ester Quat (Tetranyl L-190, Quaternized Triethanolamine Diester-90%)
7. Amino trimethyl phosphonic acid (Dequest 2000)
8. Lactic/Lactate Buffer Solution 88%
9. Encapsulated fragrance slurry (Polyamine Coated Capsules; about 25% Fragrance)
10. Polyacrylate thickener/in mineral oil (56%)
11. Deionized Water
12. Ice Method of Softener Preparation 1. Heat the deionized water to 65° C., add to 4000 ml beaker.
2. Add Dequest 2000 to water while variable speed mixer is on 200 RPM.
3. Heat Ester Quat to 65° C. in 600-ml beaker on magnetic stirring plate with stirring.
4. With stirring from the variable speed mixer (400 RPM), SLOWLY (at about 130 g per 3-5 min., which is 25 to 40 g/min.) add the Ester quat at 60° C. to the deionized water.
5. Mix for 10 minutes.
6. Cool the resulting mixture in an ice/water bath with continuous mixing.
7. After solution reaches 35° C. add Lactic/Lactate Buffer Solution.
8. Add Polyacrylate thick./in mineral oil (56% active), slowly at (400-RPM)
9. Continue mixing for an additional 10 minutes (at 300 RPM) to form the softener base composition.
10. Post add the Encapsulated fragrance slurry blend and mix for 30 minutes.

Fabric Softener Formulations

TABLE 1

| Ingredients | Sample 1 (wt %) | Sample 2 (wt %) |
|---|---|---|
| Di-tallow ester Quaternary ammonium methylsulfate (L-190 from Kao) | 8.667 | 8.667 |
| Dequest 2000 | 0.100 | 0.100 |
| Lactic/lactate buffer | 0.063 | 0.063 |
| Polyacrylate thick./in mineral oil, SNF polymer (56% active) | 0.268 | 0.00 |
| Encapsulated fragrance slurry (Polyamine Coated Capsules; about 25% Fragrance) | 3.6 | 3.6 |
| Deionized water | balance | balance |

EXAMPLE 2

Method of Softener Preparation

1. Heat the deionized water to 65° C., add to 4000 ml beaker.
2. Add Dequest 2000 to water while variable speed mixer is on 200 RPM.
3. Heat Ester Quat to 65° C. in 600-ml beaker on magnetic stirring plate with stirring.
4. With stirring from the variable speed mixer (400 RPM), SLOWLY (at about 130 g per 3-5 min., which is 25 to 40 g/min.) add the Ester quat at 60° C. to the deionized water. Then add the Encapsulated fragrance slurry (and a neat fragrance oil; added in one formula) to the hot emulsion.
5. Mix for 10 minutes.
6. Cool the resulting mixture in an ice/water bath with continuous mixing.
7. After solution reaches 35° C. add Lactic/Lactate Buffer Solution.
8. Add Polyacrylate thick./in mineral oil (56% active), slowly at (400-RPM)
9. Continue mixing for an additional 10 minutes (at 300 RPM) to form the softener base composition.

Fabric Softener Formulations

TABLE 2

| Ingredients | Sample 3 (wt %) | Sample 4 (wt %) | Sample 5 (wt %) | Sample 6 (wt %) |
|---|---|---|---|---|
| Di-tallow ester Quaternary ammonium methylsulfate (L-190 from Kao) | 8.667 | 8.667 | 8.667 | 8.667 |
| Dequest 2000 | 0.100 | 0.100 | 0.100 | 0.100 |
| Lactic/lactate buffer | 0.063 | 0.063 | 0.063 | 0.063 |
| Polyacrylate thick./in mineral oil, SNF polymer (56% active) | 0.268 | 0 | 0.268 | 0 |
| Encapsulated fragrance slurry (Cationic Polymer Coated Capsules; about 25% Fragrance) | 3.6 | 3.6 | 1.8 | 1.8 |
| Neat fragrance oil | — | — | 0.45 | 0.45 |
| Deionized water | balance | balance | balance | balance |

Introduction to Sensory Panel Evaluation

The performance of the capsules on dry towels was assessed by a fragrance evaluation panel. The Fragrance Panel had twenty evaluators. The objective of this panel was to determine which one of the two samples has higher fragrance intensity on dry towels (before rubbing and after rubbing).

In order to evaluate the fragrance on dry towels, each panelist was given two towels (1 of each product) and instructed to smell both towels and identify which towels is more intense. Their response was recorded and then the panel moderator grasped a side of the towel with each hand and rubbed the towel 6 times back and forth vigorously. This was done for both towels. The panelist was then instructed to smell the portion of the towels that had been rubbed and identify which towel is more intense. Again their response was recorded and that set of towels were discarded. Each panelist evaluated their own set of towels.

Introduction to Test Conditions

For all Samples evaluations 24 new hand Terry towels (86% Cotton, 14% Polyester) were prepared in a 17 gallon top loading washing machine set for hot wash (120 F), with extra large setting, in tap water. Two wash cycles with 100 g Fab (fragrance free base), one wash with water only, extra rinse was used for last two cycles. After all three wash cycles were over, the towels were dryer dried in an electric clothes dryer, and laid flat for storage. The same procedure was used for stripping "ballast load."

Twelve (12) terry towels per sample together with a ballast to make a 4 kg wash load were then washed with water under Mexican conditions in US Whirlpool (57L top loading washing machine set on large setting, 150 ppm water hardness, 77° F., cold rinse; 18 min wash cycle). 110 g of Fabric softeners prepared in Sample 1 and 2 were then added to the rinse cycle. The loads were then line-dried for 24 h in a conditioned room (23 C, 50% relative humidity). After aging, the Samples were compared for fragrance intensity by a Fragrance Panel. The results are shown in Table 3.

TABLE 3

(Sensory Panel Evaluation)

| | Terry Towels | | | |
|---|---|---|---|---|
| | Sample 1 vs Sample 2 Line Dry Towels (Non-Rubbed Towels) | | Sample 1 vs Sample 2 Line Dry Towels (Rubbed Towels | |
| | Sample 1 | Sample 2 | Sample 1 | Sample 2 |
| Number of Votes for Most Intense Fragrance | 12.5 | 7.5 | 14 | 6 |
| Winner | Equal | | Win Sample 1 | |

As shown in Table 3, the swatches treated with Sample 1 (with SNF polymer) were chosen by a majority of the panel to have more intense fragrance than those washed in the comparative composition (Sample 2). The difference in fragrance intensity was statistically significant at 90% confidence level after rubbing the towels.

TABLE 4

(Physical Characteristics of Samples 3–6; Initial Room Temperature)

| Characteristics | Sample 3 | Sample 4 | Sample 5 | Sample 6 |
|---|---|---|---|---|
| pH | 3.19 | 2.94 | 3.11 | 2.83 |
| Brookfield Viscosity (cP)* | 309.6 | 33 | 502.2 | 31.2 |
| Phase Stability | Yes | Yes | Yes | Yes |

Brookfield Model DV-II+ viscometer
*S2/50 rpm/30 sec

TABLE 5

(Physical Characteristics of Samples 3–6; After 12 Weeks of Aging at 110° F.)

| Characteristics | Sample 3 | Sample 4 | Sample 5 | Sample 6 |
|---|---|---|---|---|
| pH | 3.26 | 3.22 | 3.12 | 3.08 |
| Brookfield Viscosity (cP) | 501* | 69.6* | 844.8** | 58.8* |
| Phase Stability | Yes | No | Yes | Yes |

Brookfield Model DV-II+ viscometer
*S2/50 rpm/30 sec
**S3/50 rpm/30 sec

As shown in Tables 4 and 5, samples with SNF polymer are not only phase stable, but also are relatively thick. The data in Tables 3-5 clearly demonstrate the importance of SNF polymer to enhance fragrance performance, and stability. The polymer also acts as a thickener to yield desired viscosities.

What is claimed is:

1. A fabric softener composition comprising:

(a) 0.01% to 50% weight of a cationic softening compound which is a fatty ester quaternary ammonium compound;

(b) at least 0.001%, by weight, of a water dispersible cross-linked cationic polymer derived from the polymerization of 5 to 100 mole percent of a cationic vinyl addition monomer, 0 to 95 mole percent of acrylamide, and 5 to 500 ppm of a difunctional vinyl addition monomer cross-linking agent;

(c) 0 to 5% by weight of a non-confined fragrance oil; and (d) an effective amount of at least one fabric or skin beneficiating ingredient encapsulated within a first polymer material to form a polymer encapsulated beneficiating ingredient, said encapsulated ingredient being further coated with a cationic polymer which is a cationic polyamine that is a reaction product of a polyamine and an oxirane material.

2. The composition of claim 1 wherein said fatty ester quaternary ammonium compound is a biodegradable fatty ester quaternary ammonium compound having the formula:

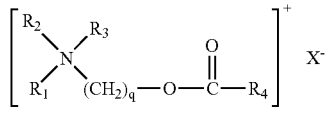

wherein $R_1$ represents $(CH_2)_1R_6$ where $R_6$ represents benzyl, phenyl, $(C_1\text{-}C_4)$alkyl substituted phenyl, OH, or H;

$R_2$ and $R_3$ represent $(CH_2)_8$—$R_5$ where $R_5$ represents an alkoxy carbonyl group containing 8 to 22 carbon atoms, benzyl, phenyl, $(C_1\text{-}C_4)$alkyl substituted phenyl, OH, or H;

$R_4$ represents an aliphatic hydrocarbon group having 8 to 22 carbon atoms;

q, s, and t each independently represent an integer 1 to 3; and $X^-$ is a softener compatible anion.

3. The composition of claim 1 having a biodegradable fatty ester quaternary ammonium compound derived from the reaction of an alkanol amine and a fatty acid derivative followed by quaternization, said fatty ester quaternary ammonium compound being represented by the formula:

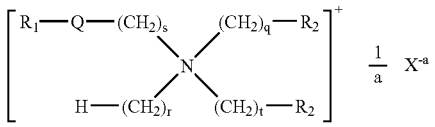

wherein

Q represents a carboxyl group having the structure —OCO— or —COO—;

$R_1$ represents an aliphatic hydrocarbon group having 8 to 22 carbon atoms;

$R_2$ represents -Q-$R_1$ or —OH;

q, r, s, and t each independently represent a number of 1 to 3; and $X^{-a}$ is an anion of valence a; and wherein said fatty ester quaternary ammonium compound is comprised of a distribution of monoester, diester and triester compounds, the monoesterquat compound being formed when each $R_2$ is —OH; the diesterquat compound being formed when one $R_2$ is —OH and the other $R_2$ is -Q-$R_1$; and the triesterquat compound being formed when each $R_2$ is -Q-$R_1$; and wherein the normalized percentage of monoesterquat compound in said fatty ester quaternary ammonium compound is 28% to 39%; the normalized percentage of diesterquat compound is 52% to 62%, and the normalized percentage of triesterquat compound is 7% to 14%; all percentages being by weight.

4. The composition of claim 1 wherein said cross-linked cationic polymer is a cross-linked copolymer of a quaternary ammonium acrylate or methacrylate in combination with an acrylamide co-monomer.

5. The composition of claim 1 wherein said encapsulating polymer in (d) is selected from the group consisting of a vinyl polymer, an acrylate polymer, melamine formaldehyde polymer, urea formaldehyde polymer, and mixtures thereof.

6. The composition of claim 1 wherein the oxirane material is selected from the group consisting of (chloromethyl) oxirane, (bromoethyl) oxirane, and mixtures thereof.

7. The composition of claim 1 wherein the fabric or skin beneficiating ingredient is selected from the group consisting of perfumes or fragrance oils, anti-bacterial agents, vitamins, skin conditioners, UV absorbers, and enzymes.

8. The composition of claim 7 wherein the fabric or skin beneficiating ingredient is a perfume or fragrance oil.

9. The composition of claim 7 wherein the perfume or skin beneficiating ingredient is mixed with a polymer or non-polymeric carrier material or surfactant or solvent or mixtures thereof.

10. The composition of claim 1 which is in the form of a liquid, powder, or gel.

11. The composition of claim 1 further comprising at least 0.001% of a chelating compound capable of chelating metal ions and selected from the group consisting of amino carboxylic add compounds, organo aminophosphonic acid compounds, and mixtures thereof.

12. A method of imparting softness to fabrics comprising contacting said fabrics with an effective amount of a composition of claim 1.

13. The method of claim 12 wherein said fabrics are contacted during the rinse cycle of a laundry washing machine or hand wash laundry treatment.

14. The method of claim 12 wherein said fabric softening compound is a fatty ester quaternary ammonium compound.

15. The method of claim 14 wherein said fatty ester quaternary ammonium compound has the formula:

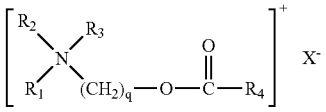

wherein $R_1$ represents $(CH_2)_1$ $R_6$ where $R_6$ represents benzyl, phenyl, $(C_1$-$C_4)$alkyl substituted phenyl, OH, or H;

$R_2$ and $R_3$ represent $(CH_2)_s$—$R_5$ where $R_5$ represents an alkoxy carbonyl group containing 8 to 22 carbon atoms, benzyl, phenyl, $(C_1$-$C_4)$alkyl substituted phenyl, OH, or H;

$R_4$ represents an aliphatic hydrocarbon group having 8 to 22 carbon atoms;

q, s, and t each independently represent an integer from 1 to 3; and $X^-$ is a softener compatible anion.

16. The method of claim 14 wherein the fatty ester quaternary ammonium compound is derived from the reaction of an alkanol amine and a fatty acid derivative followed by quaternization, said fatty ester quaternary ammonium compound being represented by the formula:

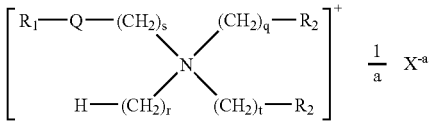

wherein

Q represents a carboxyl group having the structure —OCO— or —COO—;

$R_1$ represents an aliphatic hydrocarbon group having 8 to 22 carbon atoms;

$R_2$ represents -Q-$R_1$ or —OH;

q, r, s, and t each independently represent a number of 1 to 3; and $X^{-a}$ is an anion of valence a; and wherein said fatty ester quaternary ammonium compound is comprised of a distribution of monoester, diester and triester compounds, the monoesterquat compound being formed when each $R_2$ is —OH; the diesterquat compound being formed when one $R_2$ is —OH and the other $R_2$ is -Q-$R_1$; and the triesterquat compound being formed when each $R_2$ is -Q-$R_1$; and wherein the normalized percentage of monoesterquat compound in said fatty ester quaternary ammonium compound is from 28% to 39%; the normalized percentage of diesterquat compound is from 52% to 62%, and the normalized percentage of triesterquat compound is from 7% to 14%; all percentages being by weight.

17. The method of claim 12 wherein said fabric or skin beneficiating ingredient is a perfume or fragrance oil.

18. The method of claim 17 wherein said encapsulating polymer for said perfume or fragrance oil is a vinyl polymer, an acrylate polymer, melamine formaldehyde polymer, urea formaldehyde polymer, or mixtures thereof.

19. A non-aqueous fabric softener composition comprising:

(a) 0.01% to 50% by weight of a cationic softening compound;

(b) at least 0.001%, by weight, of a water dispersible cross-linked cationic polymer derived from the polymerization of 5 to 100 mole percent of a cationic vinyl addition monomer, 0 to 95 mole percent of acrylamide, and 5 to 500 ppm of a difunctional vinyl addition monomer crosslinking agent;

(c) 0 to 5% by weight of a non-confined fragrance oil; and (d) an effective amount of at least one fabric or skin beneficiating ingredient encapsulated within a first polymer material to form a polymer encapsulated beneficiating ingredient, said encapsulated ingredient being further coated with a cationic polymer;

wherein the composition is in the form of a fabric softener sheet.

20. A non-aqueous fabric softener composition comprising:

(a) 0.01% to 50% by weight of a cationic softening compound which is a fatty ester quaternary ammonium compound;

(b) at least 0.001%, by weight, of a water dispersible cross-linked cationic polymer derived from the polymerization of 5 to 100 mole percent of a cationic vinyl addition monomer, 0 to 95 mole percent of acrylamide, and 5 to 500 ppm of a difunctional vinyl addition monomer cross-linking agent;

(c) 0 to 5% by weight of a non-confined fragrance oil; and (d) an effective amount of at least one fabric or skin beneficiating ingredient encapsulated within a first polymer material to form a polymer encapsulated beneficiating ingredient, said encapsulated ingredient being further coated with a cationic polymer which is a cationic polyamine that is a reaction product of a polyamine and an oxirane material.

21. The composition of claim 20 wherein the oxirane material is selected from the group consisting of (chloromethyl) oxirane, (bromoethyl) oxirane, and mixtures thereof.

* * * * *